US006860715B2

(12) United States Patent
Sekularac

(10) Patent No.: US 6,860,715 B2
(45) Date of Patent: Mar. 1, 2005

(54) CENTRIFUGAL COMPRESSOR WHEEL

(75) Inventor: Aleksandar Sekularac, Fletcher, NC (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 10/422,245

(22) Filed: Apr. 24, 2003

(65) Prior Publication Data

US 2004/0213661 A1 Oct. 28, 2004

(51) Int. Cl.[7] ..... F01D 5/14
(52) U.S. Cl. ..... 415/115; 415/914
(58) Field of Search ..... 415/115, 914, 415/2, 6; 416/181–183, 185–188, 231 R, 227, 228, 90 R

(56) References Cited

U.S. PATENT DOCUMENTS 1,071,660 A * 8/1913 Banner ..... 416/182
1,622,930 A * 3/1927 Von Karman et al. ..... 416/183
1,829,674 A * 10/1931 Rosenlocher ..... 96/188
2,161,182 A * 6/1939 Massey ..... 18/186
2,166,823 A * 7/1939 Rosenlocher ..... 415/208.1
3,749,520 A * 7/1973 Bandukwalla ..... 416/183
5,255,514 A * 10/1993 Wentworth, Jr. ..... 60/605.1
5,480,284 A * 1/1996 Wadia et al. ..... 416/91

* cited by examiner

*Primary Examiner*—Edward K. Look
*Assistant Examiner*—James M. McAleenan
(74) *Attorney, Agent, or Firm*—Pendorf & Cutliff; Greg Dziegielewski

(57) ABSTRACT

As air passes through the airflow channels (46) between the blades (10) of a compressor impeller, boundary layers build up on the blade (10) surfaces. These low momentum masses of air are considered a blockage and loss generators. Ultimately, the boundary layer on the suction side of the blade (20) will separate, causing stall and reversed flow. Reversed flow will occur until a stable pressure ratio with positive volume flow rate is reached. When the pressure ratio becomes unstable again, the cycle will repeat. Introducing a slit (12) or a series of perforations (28) on the compressor wheel blade (10) allows the air to communicate between the pressure side (18) and the suction side (20) of the blade, which allows the boundary layer to stay attached longer. The invention allows for various shapes, positions, lengths and widths, locations, and arrangements of either a slit (12) or a series of perforations (28) on the compressor blade (10) in order to accomplish the objectives of delaying surge conditions by prolonging the boundary layer adherence to the suction side (20) of the compressor blade (10) and of maintaining a low level of noise emission, ease of manufacturing, and structural integrity.

16 Claims, 3 Drawing Sheets

CENTRIFUGAL COMPRESSOR WHEEL

FIELD OF THE INVENTION

The present invention concerns a compressor impeller wheel for use in turbochargers on internal combustion engines and more particularly to a design modification to reduce surge associated with airflow.

BACKGROUND OF THE RELATED ART

Turbochargers are widely used on internal combustion engines, and in the past have been particularly used with large diesel engines, especially for highway trucks and marine applications. Compressor impeller wheels are found in both superchargers, which derive their power directly from the crankshaft of the engine, and turbochargers, which are driven by the engine exhaust gases.

More recently, in addition to use in connection with large diesel engines, turbochargers have become popular for use in connection with smaller, passenger car power plants. The use of a turbocharger in passenger car applications permits selection of a power plant that develops the same amount of horsepower from a smaller, lower mass engine. Using a lower mass engine has the desired effect of decreasing the overall weight of the car, increasing sporty performance, and enhancing fuel economy. Moreover, use of a turbocharger permits more complete combustion of the fuel delivered to the engine, thereby reducing the hydrocarbon emissions of the engine, which contributes to the highly desirable goal of a cleaner environment.

The design and function of turbochargers are described in detail in the prior art, for example, U.S. Pat. Nos. 4,705,463, 5,399,064, and 6,164,931, the disclosures of which are incorporated herein by reference.

Turbocharger units typically include a turbine operatively connected to the engine exhaust gas manifold, a compressor operatively connected to the engine air intake manifold, and a shaft connecting the turbine and compressor so that rotation of the turbine wheel causes rotation of the compressor impeller. The turbine is driven to rotate by the exhaust gas flowing in the exhaust manifold. The compressor impeller is driven to rotate by the turbine, and as it rotates, it increases the air mass flow rate, airflow density and air pressure delivered to the engine cylinders.

Turbocharger compressors consist of three fundamental components: compressor wheel, diffuser, and housing. The compressors work by drawing air in axially, accelerating the air to a high velocity through the rotational speed of the wheel, and expelling the air in a radial direction. The diffuser slows down the high-velocity air, which in exchange increases the pressure and the temperature. The diffuser is formed by the compressor backplate and a part of the volute housing, which in turn collects the air and slows it down before it reaches the compressor exit.

The blades of a compressor wheel have a highly complex shape, for (a) drawing air in axially, (b) accelerating it centrifugally, and (c) discharging air radially outward at an elevated pressure into the volute-shaped chamber of a compressor housing. In order to accomplish these three distinct functions with maximum efficiency and minimum turbulence, the blades can be said to have three separate regions.

First, the leading edge of the blade can be described as a sharp pitch helix, adapted for scooping air in and moving air axially. Considering only the leading edge of the blade, the cantilevered or outboard tip travels faster (MPS) than the part closest to the hub, and is generally provided with an even greater pitch angle than the part closest to the hub. Thus, the angle of attack of the leading edge of the blade undergoes a twist from lower pitch near the hub to a higher pitch at the outer tip of the leading edge. Further, the leading edge of the blade generally is bowed, and is not planar. Further yet, the leading edge of the blade generally has a "dip" near the hub and a "rise" or convexity along the outer third of the blade tip. These design features are all designed to enhance the function of drawing air in axially.

Next, in the second region of the blades, the blades are curved in a manner to change the direction of the airflow from axial to radial, and at the same time to rapidly spin the air centrifugally and accelerate the air to a high velocity, so that when diffused in a volute chamber after leaving the impeller, the energy is recovered in the form of increased pressure. Air is trapped in airflow channels defined between the blades, as well as between the inner wall of the compressor wheel housing and the radially enlarged disc-like portion of the hub which defines a floor space, the housing-floor spacing narrowing in the direction of air flow.

Finally, in the third region, the blades terminate in a trailing edge, which is designed for propelling air radially out of the compressor wheel. The design of this blade trailing edge is generally complex, provided with (a) a pitch, (b) an angle offset from radial, and/or (c) a back taper or back sweep (which, together with the forward sweep at the leading edge, provides the blade with an overall "S" shape). Air expelled in this way has not only high flow, but also high pressure.

The operating behavior of a compressor within a turbocharger may be graphically illustrated by a "compressor map" associated with the turbocharger in which the pressure ratio (compression outlet pressure divided by the inlet pressure) is plotted on the vertical axis and the flow is plotted on the horizontal axis. In general, the operating behavior of a compressor wheel is limited on the left side of the compressor map by a "surge line" and on the right side of the compressor map by a "choke line." The surge line basically represents "stalling" of the airflow at the compressor inlet. As air passes through the air channels between the blades of the compressor impeller, boundary layers build up on the blade surfaces. These low momentum masses of air are considered a blockage and loss generators. When too small a volume flow and too high of an adverse pressure gradient occurs, the boundary layer can no longer adhere to the suction side of the blade. When the boundary layer separates from the blade, stall and reversed flow occurs. Stall will continue until a stable pressure ratio, by positive volumetric flow rate, is established. However, when the pressure builds up again, the cycle will repeat. This flow instability continues at a substantially fixed frequency, and the resulting behavior is known as "surging."

The "choke line" represents the maximum centrifugal compressor volumetric flow rate as a function of the pressure ratio, which is limited for instance by the minimal cross-section of the channel between the blades, called the throat. When the flow rate at the compressor inlet or other throat location reaches sonic velocity, no further flow rate increase is possible and choking results. Both surge and choking of a compressor should be avoided.

In attempting to adapt and/or optimize available compressors for use on turbocharger assemblies suitable for various type internal combustion engines, rather than design totally new compressors, the problem most frequently encountered is that the available compressors have insufficient compressor map width, i.e., the operating range of the compressors is too narrow to satisfy the air requirements of the particular engine while, at the same time, operating efficiently under the speed (rpm) conditions imposed by the engine. In an attempt to design around this problem, engine manufacturers have been forced to offer narrower speed range engines than would otherwise be desirable. Alternatively, in some instances, where available and practical, greater capacity, albeit more expensive, compressors are employed.

The problem of the boundary layer separating from the blade can be reduced somewhat by using backward-swept blade tips. Blade backsweep results in long, gradually expanding airflow channels, which slows the airflow and produces less boundary layer separations. However, compressor efficiency is still limited by the flow instability.

An attempt to avoid surge can be found in U.S. Pat. No. 4,743,161 to Fisher et al. Fisher et al. show a recirculation passage in a turbocharger compressor housing. The recirculation passage is designed to produce a positive differential pressure on the inlet at choke and a negative differential pressure on the inlet at surge. While the recirculation passage helps to reduce the pressure differential, it creates additional problems. For example, the recirculation passage increases the amount of noise emitted, there are casting problems associated with creating a small recirculation passage inside the housing piece, there are increased manufacturing costs, and there are cleaning problems associated with keeping the recirculation passage clear from debris and preventing breakdown. Further, in recirculation, the same air is passed through the compressor passage twice, increasing the workload on the compressor.

Another approach involves a bypass port compressor. This turbocharger has a center channel that flows directly into the compressor wheel and also has an annular channel which acts as a bypass and provides flow either into or out of the compressor wheel. At low speeds, which might otherwise cause surge conditions because the volume of air provided is insufficient for the system's requirements, the bypass port allows additional air mass into the compressor impeller, allowing the system to reach equilibrium. At high speeds, which might otherwise cause a choke condition because the system's air requirements exceed the compressor's maximum flow rate, the port allows surplus air mass to be redirected from the compressor wheel.

However, the problem with this type of compressor is that there is a significant increase in noise. The port, or bypass, provides a direct path to the compressor wheel, and thus provides a means for the noise (and sound waves) generated by the high-speed revolutions of the compressor wheel to exit the compressor housing. Methods for controlling the emissions, such as inserting baffles along the annular channel, increase the cost of manufacture.

Another method for preventing surge conditions involves swirling the inducted airflow. When the induction volume falls to a level at which surging is apt to occur, it is known to swirl the inducted air flow upstream of the turbo compressor wheel in order to suppress or lower the surge limit of a turbo compressor. This reduces the angle of incidence of the incoming flow of air on the blades of the compressor wheel suppressing the surge limit. However, the problem with this approach is that turbulent flows created by pressure differentials cause a vibration, which under given operational conditions, tends to maximize or resonate to the degree of damaging the blades of the compressor. Moreover, construction of the vanes used to swirl the upstream air is complex and difficult to install in the confined space available in an induction housing.

Recently, WO 03/008787 to International Engine Intellectual Property Company, LLC was published disclosing an engine control unit (ECU) employed to reduce any significant turbocharger surge. The strategy for reducing surge conditions is implemented via a processor-based ECU. The ECU utilizes data relating to certain engine operating parameters to control the bleed of compressed charge air from the engine intake system via an exhaust valve located at the outlet of the compressor. The controlled bleeding counters any incipient surging of the compressor that results from increasingly retarding the timing of the exhaust valve opening/and the accompanying increase in fueling. By bleeding the air away from the intake manifold, the intake manifold pressure can increase without surge.

However, the problem with this invention is that it increases the cost of the turbocharger unit. Additionally, the useful benefits of the invention are countered by the expense of increased fuel consumption and reduced engine torque which occurs as a result of increased engine pumping loss.

The inventor saw a need for a device to reduce surge in a compressor impeller wheel. The device also needed to be cost efficient, fuel-efficient and inexpensive to manufacture.

SUMMARY OF THE INVENTION

The inventor solved the problem of reducing surge as a result of several life experiences. The inventor has a background in aerospace engineering, which involves the study of airfoils, i.e. lift, pressure, stall, boundary layers, etc. Devices like wing slats and blown flaps are commonly used to increase the wing performance at low speeds and high angles of attack (take-of and landing conditions). Under these conditions, the wing is prone to stall because lift force is lost due to the separation of the boundary layer over the suction surface of the wing. This is caused by the same low flow velocity and adverse pressure gradient over the airfoil, as described above in radial compressors. Utilizing wing slats and multi-element flaps re-energizes the boundary layer by introducing additional air mass from the pressure side of the wing to the suction side, hence keeping the boundary layer attached and delaying separation. Through his occupation, the inventor also became familiar with the many different ways in which a turbocharger unit can be modified in order to increase efficiency and air flow.

As a result of his background in aerospace engineering and his familiarity with attempts to avoid stall and choke in turbocharger systems, the inventor realized that a slit in the compressor blade might be beneficial. However, the inventor was also aware of the limitations involved with introducing a slit into a compressor blade. Introducing slits into compressor blades would seem to weaken the structural integrity of the blade and reduce the efficiency of the blade to move air.

By introducing some of the air from the pressure side of the blade to the suction side of the blade through a slit in the blade, the inventor was able to reenergize the boundary layer. This allows the boundary layer to stay attached, minimizing blockage and reverse flow. Various shapes, positions, lengths and widths, locations, and arrangements of either a slit or a series of perforations on the compressor blade can be used to accomplish this objective.

This invention accomplishes the objectives of avoiding surge conditions by prolonging the boundary layer adherence to the suction side of the compressor blade, by maintaining a low level of noise emission, and by continuing to provide ease of manufacturing. There is also no significant reduction in structural integrity, and the benefits of the slit feature outweigh any reduction in the structural integrity. Further, because the air does not have to be recirculated, all of the air already in the compressor is used more efficiently.

In a first embodiment, the blade slit should be introduced on the blade just ahead of the point of predicted separation and flow reversal, according to the airflow. The point of predicted separation can be derived from computer modeling and analysis. The point of predicted separation and flow reversal usually occurs near the shroud on the suction side of the blade, in the second part of the blade channel, close to the point of highest curvature (where the flow changes its direction, both axially and radially). The slit can be shaped as one continuous opening through the blade extending from the shroud contour. The slit should be oriented at an angle somewhat perpendicularly to the hub, but it is not limited to any certain angle of placement.

The dimensions of the slit, the slit width and slit length, are variable and dependent upon the flow conditions and blade design. Generally, the slit length should extend approximately one third of the distance in the shroud-hub direction. A slit width of approximately 2–3 mm should be appropriate.

Each blade of the compressor wheel should contain one or more of these slits. The shape of the slit is not constrained beyond that of the designer's imagination or the cost of manufacturing the slit. The slit can be shaped in a somewhat linear rectangular shape with various contours, it can be curved at any angle (for example, as a "c" or "L" shaped slit), or it can be rounded.

A second embodiment of the invention occurs as one or more perforations that do not necessarily disrupt the continuity of the blade shroud contour. The perforations should be located on the blade just ahead of the point of predicted separation and flow reversal, according to the airflow. The series of perforations can be oriented: perpendicularly extending from in the shroud-hub direction, in a streamwise orientation (parallel to the hub line), or in any angle variation thereof.

The dimensions of the series of perforations: the perforation width, perforation length, the number of individual perforations, and the number of rows or grouping of perforations, are variable and dependent upon the flow conditions and blade design. The perforation width in the second embodiment should be approximately 2 mm.

Each blade of the compressor wheel should contain one or more of these series of perforations. Also, the shape of the perforations is not constrained beyond that of the designer's imagination or the cost of manufacturing the series of perforations. The perforations can be linear, curved, rounded, elliptical, spherical, conical or cylindrical in shape.

The slit and series of perforations can be used in any combination on the compressor wheel blades.

These and other aspects of the invention will be more apparent from the following description of the preferred embodiments thereof when considered in connection with the accompanying drawings and appended claims.

BRIEF DESCRIPTION OF THE DRAWINGS

For a fuller understanding of the nature and objects of the present invention reference should be made by the following detailed description taken in with the accompanying drawings in which.

DESCRIPTION OF THE PREFERRED EMBODIMENTS

Figure 1:
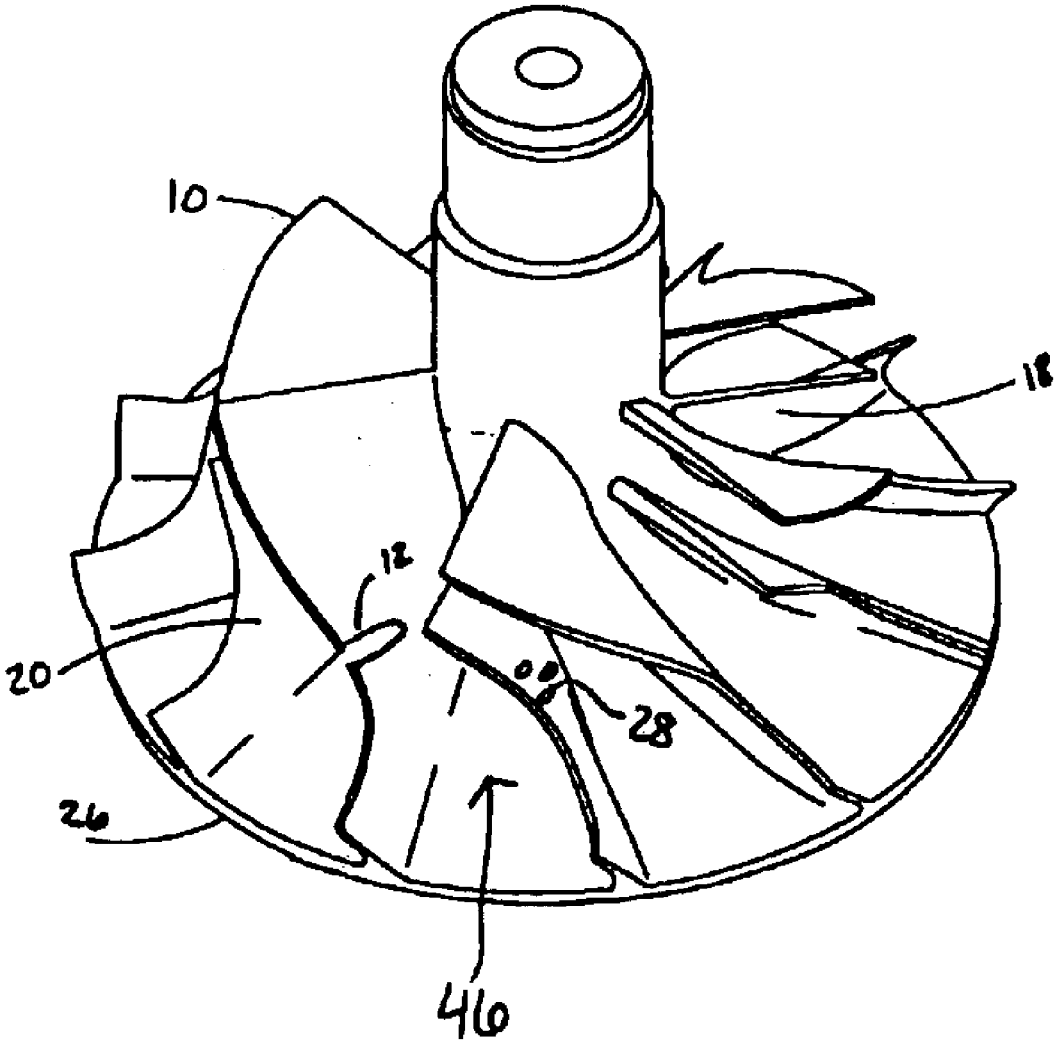
FIG. 1 shows a compressor wheel according to the invention.

FIG. 1 shows a compressor wheel according to the prior art. The air is trapped between the blades 10 and the compressor wheel hub 26 in an area called airflow channels 46. The suction side of the blade 20 is the area of low pressure, and the pressure side of the blade 18 is the area of high pressure. As the air passes through the airflow channels 46, boundary layers build up on the blade surfaces. These low momentum masses of air are considered a blockage and cause surge conditions. Ultimately, the boundary layer on the suction side of the blade 20 will separate, causing stall and reversed flow. This can be prevented, or at least delayed, by introducing some of the high-energy flow from the pressure side of the blade 18 into the low-energy side of the suction side of the blade 20 via a slit 12 or series of perforation 28 features.

Figure 2:
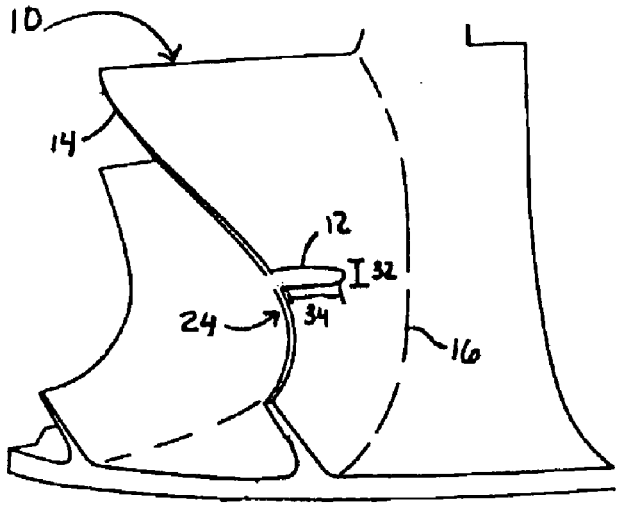
FIG. 2 depicts an enlarged partial section of a compressor wheel containing a second embodiment of the series of perforations feature of the present invention, in elevated perspective view.

FIG. 2 depicts an elevated perspective view of a compressor impeller blade 10. The compressor impeller blade 10 is connected to the compressor wheel hub 26 (not shown) along the hub line 16 and is housed in the compressor housing (not shown). The shroud line 14 of the blade 10 is adapted to have small clearance to the compressor housing (not shown) as required for flow efficiency through the compressor wheel. The blade 10 curves, and the highest degree of blade curvature 24 is usually located around the middle one third of the blade 10. The point of predicted flow separation, derived from computer modeling and analysis, usually occurs near the shroud line 14 on the suction side 20 (not shown) of the blade at the location of the highest degree of blade curvature 24. Therefore, in order to prevent flow separation, the slit 12 should be located ahead of the highest degree of blade curvature 24, according to the airflow.

The slit 12 extends at least 0.1 mm from the shroud line 14, but does not extend more than 75% of the distance between the shroud line 14 and the hub line 16. The slit 12 has a slit width 32 sufficient to allow air to communicate between the pressure side of the blade 18 (not shown) and the suction side of the blade 20 (not shown), dependent upon flow conditions and blade design. The dimensions of the slit 12 may vary depending upon the particular compressor configuration and intended usage, but there are particularly desirable dimensional relationships that enhance the working range of axial flow compressors without significant loss of efficiency, which is a goal of this invention. In the first embodiment, the slit width 32 is approximately 2–3 mm and the slit length 34 is approximately one-third of the distance between the shroud line 14 and the hub line 16. In the first embodiment, the slit 12 has a linear shape and is oriented perpendicularly to the hub line 16 on the blade 10. Each blade 10 should contain one or more slits 12.

Figure 3:
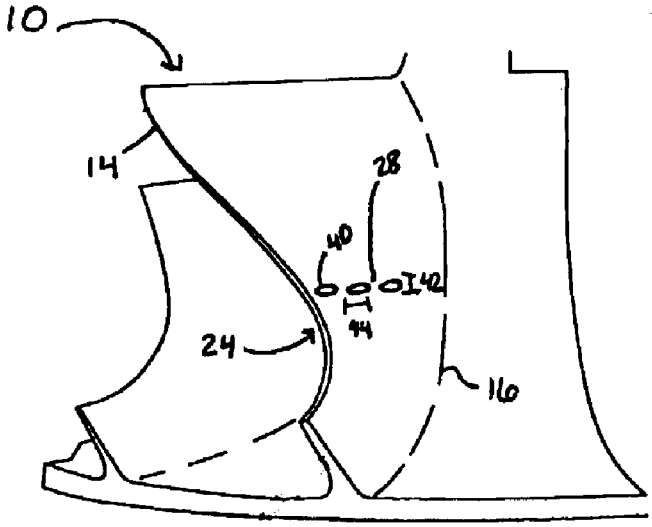
FIG. 3 depicts an enlarged partial section of a compressor wheel containing a first embodiment of the slit feature of the present invention, in elevated perspective view.

FIG. 3 depicts an enlarged partial compressor impeller blade 10 in the second embodiment with a series of perforations 28. Each individual perforation 40 can be measured by the perforation width 42 and by the perforation length 44. The series of perforations 28 have a perforation width 42 sufficient to allow air to communicate between the pressure side of the blade 18 (not shown) and the suction side of the blade 20 (not shown), dependent upon flow conditions and blade design. The dimensions of the series of perforations 28 may vary depending upon the particular compressor configuration and intended usage, but there are particularly desirable dimensional relationships that enhance the working range of axial flow compressors without significant loss of efficiency, which is a goal of this invention. In the second embodiment, the perforation width 42 is approximately 2 mm.

The series of perforations 28 do not necessarily intersect with the shroud line 14. The series of perforations 28 can be oriented at an angle perpendicular to the hub line 16, at an angle parallel to the hub line 16, which is called the streamwise direction, or at any other angle. Additionally, the second embodiment is a linear arrangement of circularly shaped individual perforations, with the series of perforations 28 oriented at an angle perpendicular to the blade 10.

The blade 10 curves, and the highest degree of blade curvature 24 is usually located around the middle one third of the blade 10. The point of predicted flow separation, derived from computer modeling and analysis, usually occurs at the location of the highest degree of blade curvature 24 and near the shroud line 14 on the suction side of the blade 20 (not shown). Therefore, in order to prevent flow separation, the series of perforations 28 should be located ahead of the highest degree of blade curvature 24, according to the airflow.

The grouping arrangement or the number of rows for the series of perforations 28 is variable. The series of perforations 28 could be arranged in a linear order, with some degree of curvature, or in a random array. Each blade 10 should contain one or more series of perforations 28. The shape of the individual perforation 40 can be linear, curved, rounded, elliptical, spherical, conical, cylindrical or any variation therein. Each blade 10 should have at least one series of perforations 28.

Figure 4:
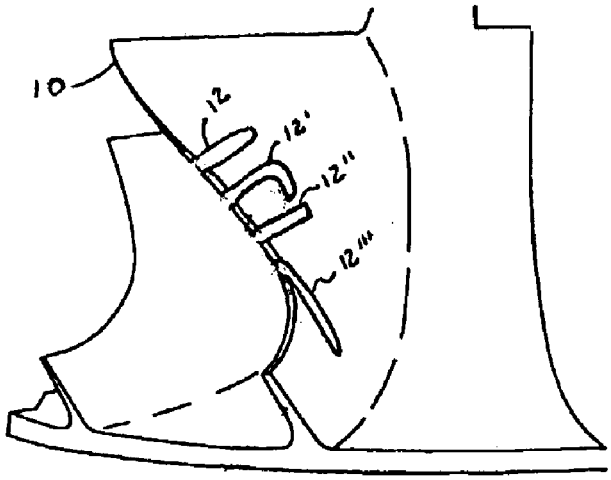
FIG. 4 shows an enlarged section of a compressor wheel blade depicting several examples of the slit feature.

FIG. 4 shows a compressor wheel blade 10 with various examples of the potential locations and shapes of the slits 12. Slit 12 is linear in shape and is oriented perpendicularly to the hub line 16. Slit 12' is somewhat "L" shaped. Slit 12" has a linear, rectangular shape. Slit 12''' is oriented less perpendicularly to the hub line 16.

Figure 5:
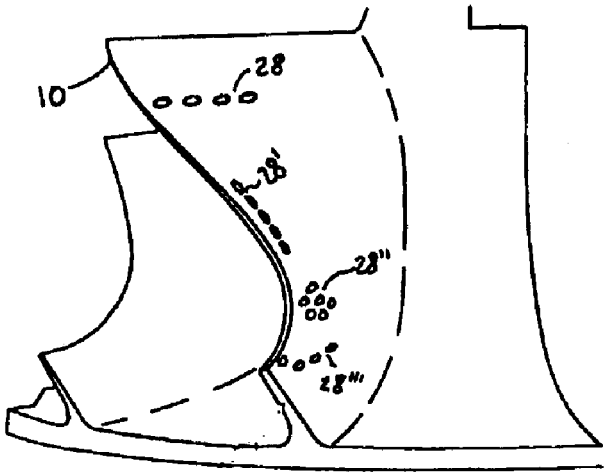
FIG. 5 shows an enlarged section of a compressor wheel blade depicting several examples of the series of perforations feature.

FIG. 5 shows a compressor wheel blade 10 with various examples of the potential locations, shapes and arrangements of the series of perforations 28. The series of perforations 28 is positioned in a linear grouping and is perpendicular to the hub line 16. The series of perforations 28' is positioned in a streamwise orientation on the blade 10. The series of perforations 28" is grouped in a random array. The series of perforations 28''' is grouped with some degree of curvature.

Various modifications and changes may be made by those having ordinary skill in the art without departing from the spirit and scope of this invention. Therefore, it must be understood that the illustrated embodiments of the present invention have been set forth only for the purpose of example, and that they should not be taken as limiting the invention as defined in the following claims.

The words used in this specification to describe the present invention are to be understood not only in the sense of their commonly defined meanings, but to include by special definition, structure, material, or acts beyond the scope of the commonly defined meanings. The definitions of the words or elements of the following claims are, therefore, defined in this specification to include not only the combination of elements which are literally set forth, but all equivalent structure, material, or acts for performing substantially the same function in substantially the same way to obtain substantially the same result.

In addition to the equivalents of the claimed elements, obvious substitutions now or later known to one of ordinary skill in the art are defined to be within the scope of the defined elements.

The claims are thus to be understood to include what is specifically illustrated and described above, what is conceptually equivalent, what can be obviously substituted, and also what incorporates the essential idea of the invention.

I claim:

1. A turbocharger compressor comprising:

a) a compressor housing; and b) a centrifugal compressor wheel positioned within said compressor housing, said centrifugal compressor wheel comprising:

i. a compressor wheel hub;

ii. a plurality of blades (10) attached to said hub along a hub line (16); each blade (10) having a shroud line (14) adapted to having a small clearance to the compressor housing; each blade (10) having a pressure side (18) and a suction side (20); each blade characterized by a point of predicted flow separation at the point of maximum adverse pressure gradient; each blade (10) having at least one slit (12) extending from said shroud line (14); and said at least one slit (12) defining an air passage between said suction side (20) and said pressure side (18) of said blade(10), wherein said at least one slit (12) is provided at or near said point of predicted flow separation.

2. The turbocharger compressor of claim 1, wherein:

said slit (12) has a slit length (34) of at least 0.1 mm.

3. The turbocharger compressor of claim 1, wherein:

said slit (12) has said slit length (34) of no more than 75% of the distance between said shroud line (14) and said hub line (16).

4. The turbocharger compressor of claim 1, wherein:

said slit (12) is provided ahead of a point of predicted flow separation.

5. The turbocharger compressor of claim 1, wherein shape of said slit (12) is selected from the group consisting of:

a) linear;

b) curved; and c) rounded dimensions.

6. The turbocharger compressor of claim 1 wherein:

every blade (10) contains two or more slits (12).

7. A turbocharger compressor comprising:

a) a compressor housing;

b) a centrifugal compressor wheel positioned within said compressor housing, said centrifugal compressor wheel comprising:

i. a compressor wheel hub;

ii. a plurality of blades (10) attached to said hub along a hub line (16); each blade (10) having a shroud line (14) adapted to close passage to compressor housing; each blade (10) having a pressure side (18) and a suction side (20); each blade characterized by a point of predicted flow separation at the point of maximum adverse pressure gradient; each blade (10) having a series of perforations (28) comprising individual perforations (40); and said series of perforations (28) defining an air passage between said suction side (20) and said pressure side (18) of said blade (10), wherein said series of perforations (28) are limited to being at or near said point of predicted flow separation.

8. The turbocharger compressor of claim 7 wherein:

said series of perforations (28) are provided ahead of a point of predicted flow separation.

9. The turbocharger compressor of claim 7 wherein arrangement of said series of perforations (28) on said blade (10) is selected from the group consisting of:

a) a linear order;

b) some degree of curvature; and c) a random array.

10. The turbocharger compressor of claim 7 wherein:

every blade (10) contains two or more said series of perforations (28).

11. The turbocharger compressor of claim 7 wherein said individual perforations (40) are selected from the group consisting of:

linear, curved, rounded, elliptical, spherical, conical and cylindrical dimensions.

12. A method for delaying boundary layer separation on a centrifugal compressor wheel blade (10), said method comprising the steps of locating a point of predicted flow separation along said blade (10) and producing a series of perforations (28) on said blade (10) to allow air passage between said suction side (20) and said pressure side (18) of said blade (10) at or near said point of predicted flow separation wherein:

a) said centrifugal compressor wheel is positioned within a compressor housing; and b) said centrifugal compressor wheel comprises:

i. a compressor wheel hub;

ii. a plurality of said blades (10) attached to said hub along a hub line (16); each blade (10) having a shroud line (14) which is adapted to having a small clearance to the compressor housing; each blade (10) having a pressure side (18) and a suction side (20); each blade (10) having a series of perforations (28) comprising individual perforations (40); and said series of perforations (28) defining an air passage between said suction side (20) and said pressure side (18) of said blade (10).

13. A method for delaying boundary layer separation on centrifugal compressor wheel blades (10) positioned within a compressor housing, said a compressor wheel comprising a hub and a plurality of blades (10) attached to said hub along a hub line (16), each blade (10) having a shroud line (14) which is adapted to having a small clearance to the compressor housing, each blade (10) having a pressure side (18) and a suction side 20, each blade characterized by a point of predicted flow separation at the point of maximum adverse pressure gradient, said method comprising:

locating said point of predicted flow separation along said blade (10), and forming at least one slit (12) in each blade (10) at or near said point of predicted flow separation, said slit extending from said shroud line (14) and defining an air passage between said suction side (14) and said pressure side (18) of said blade (10), wherein each slit has a slit length (34) of at least 0.1 mm, said slit length (34) extending no more than 75% of the distance between said shroud line (14) and said hub line (16).

14. A turbocharger compressor as in claim 1, wherein said slit is a single slit, and wherein said slit is provided near said point of predicted flow separation.

15. A turbocharger compressor as in claim 1, wherein said compressor wheel has blades having first, second and third regions, said first region for drawing air in axially and characterized by a sharp pitch helix leading edge adapted for scooping air in and moving air axially, said second region for accelerating air centrifugally and curved in a manner to change the direction of the airflow from axial to radial, said third region for discharging air radially outward at elevated pressure, wherein said one or more slots are located only in said second region.

16. A turbocharger compressor as in claim 7, wherein said compressor wheel has blades having first, second and third regions, said first region for drawing air in axially and characterized by a sharp pitch helix leading edge adapted for scooping air in and moving air axially, said second region for accelerating air centrifugally and curved in a manner to change the direction of the airflow from axial to radial, said third region for discharging air radially outward at elevated pressure, wherein said perforations are located only in said second region.

* * * * *